US005937561A

United States Patent [19]

Abernethy

[11] Patent Number: 5,937,561

[45] Date of Patent: Aug. 17, 1999

[54] FIREARM BENCH REST

[76] Inventor: Steve T. Abernethy, P.O. Box 266, Newton, N.C. 28658

[21] Appl. No.: 09/048,141

[22] Filed: Mar. 25, 1998

[51] Int. Cl.[6] ..... F41A 23/16

[52] U.S. Cl. ..... 42/94; 89/37.04

[58] Field of Search ..... 42/94; 89/37.04; 73/167

[56] References Cited

U.S. PATENT DOCUMENTS

| | | | |
|---|---|---|---|
| 3,012,350 | 12/1961 | Wold | 42/94 |
| 3,125,929 | 3/1964 | Peasley | 89/37.04 |
| 3,343,411 | 9/1967 | Lee | 73/167 |
| 3,358,504 | 12/1967 | Freebairn | 73/167 |
| 3,621,597 | 11/1971 | Price | 42/94 |
| 3,935,657 | 2/1976 | Wade | 42/94 |
| 4,621,563 | 11/1986 | Poiencot | 89/37.04 |
| 4,841,839 | 6/1989 | Stuart | 89/37.04 |
| 4,972,619 | 11/1990 | Eckert | 42/94 |
| 5,070,636 | 12/1991 | Mueller | 42/94 |
| 5,081,783 | 1/1992 | Jarvis | 42/94 |

FOREIGN PATENT DOCUMENTS

| | | | |
|---|---|---|---|
| 537703 | 5/1922 | France | 89/37.04 |
| 31040 | 4/1904 | Switzerland | 89/37.04 |

*Primary Examiner*—Stephen M. Johnson

[57] ABSTRACT

A marksman may quickly establish the correct vertical elevation of a firearm resting on a firearm forestock support plate by providing a platform having supports adapted to rest on a surface; hingedly supporting said support plate rear end to said platform; and adjusting the elevation of said support plate front end by rotating an eccentrically mounted support member. The orientation may be adjusted by providing a stop bar depending from a front end of said support plate; mounting a rear end of said support plate for horizontal rotation with respect to a platform; and urging said stop bar to rest against either a first windage screw advancing from one side of said platform or a second windage screw advancing from the other side of said platform.

9 Claims, 5 Drawing Sheets

FIREARM BENCH REST

BACKGROUND OF THE INVENTION

1. Field of the Invention

This invention relates to rests for small long-barreled personal firearms such as rifles, and more particularly to adjustable rifle rests suitable for use in target shooting.

2. Description of the Prior Art

Numerous firearm rests have been proposed which are suitable for use in aiming and steadying a rifle for use in target shooting.

Wold, U.S. Pat. No. 3,012,350, discloses a bench rest pedestal including a triangular base having three arms, each arm being provided with a leveling screw; a housing receiving a vertical rack; and a gun forestock cradle. The housing includes a horizontal pinion engaging rack, the pinion being provided with an adjusting knob. A left-handed shooter must reverse the position of the bench rest pedestal with respect to the position of the bench rest pedestal when operated by a right-handed shooter.

Other firearm bench rests are suitable for use in only one direction and are provided with knobs providing vertical or horizontal adjustment. The knobs typically are provided on one side of the rest, so that such rests may be awkward to use by a marksman whose handedness does not agree with the design of the bench rests.

Firearm bench rests designed for vertical adjustment typically are adjusted by use of a single screw, rack, or the like. If the threads or teeth are thick or spaced widely apart, adjustment is quick, but fine adjustment is not available. If the threads or teeth are spaced closely together, fine adjustment is provided, but the precise firing position may be achievable only after the adjustment mechanism is turned for a considerable period of time.

SUMMARY OF THE INVENTION

It is therefore an object of the present invention to provide a firearm bench rest which is not only adjustable, but which is easily used by both left-handed and right-handed marksmen.

Another object of the present invention is to provide a firearm bench rest which includes both coarse and fine vertical adjustment means.

Yet another object of the present invention is to provide a method of using a firearm bench rest to provide quick and accurate aiming of a firearm.

These and other objects are provided by a firearm bench rest including a firearm forestock support plate supported by a platform. The platform may be T-shaped, including a front bar and a rear bar joined perpendicularly to the front bar at its midsection. The rear bar is supported at its rear portion by a rear support, and the front bar may be supported at its ends by vertical screws. A fluid level may be supported on the top surface of the front bar.

A hinge mounted to the platform rear bar may support the rear portion of the firearm forestock support plate. This hinge also includes a screw allowing the firearm forestock support plate to horizontally rotate over the hinge.

The front portion of the platform rear bar may include brackets carrying an eccentrically mounted rotatable support member. To each side of the rotatable support member is a lever. A threaded elevation screw may pass through an internally threaded flange of each lever. As the screw is advanced, the lever is rotated. As the lever rotates, the rotatable support member turns. As the front portion of the firearm forestock support plate rests on the eccentrically mounted rotatable support member, rotation of the lever elevates the front portion of the firearm forestock support plate.

Elevation adjustment is thereby facilitated by first turning the load-bearing vertical screws, and secondly turning the elevation screws. The elevation screws have a thread density higher than that of the vertical screws, and are not load-bearing. The approximate elevation is set by the vertical screws, and is then adjusted by use of the elevation screws.

The method of use includes orientation of the bench rest by its placement on the support surface. A stop bar depends from the front end of the firearm forestock support plate. First and second horizontally disposed windage screws are mounted to either side of the stop bar and advance toward the stop bar. A horizontally rotatable spring support bar is hingedly mounted at its proximal end to the front bar adjacent to the stop bar. The distal end of the spring support bar supports one end of a tension spring. The other end of the tension spring is mounted to the firearm forestock support plate. By rotating the spring support bar to one side or the other, the firearm forestock support plate is biased toward the distal end of the spring support bar. In this manner the stop bar rests against the windage screw desired, according to the handedness of the marksman. The marksman then uses the selected windage screw to adjust the orientation of the firearm forestock support plate to properly orient the firearm.

BRIEF DESCRIPTION OF THE DRAWINGS

In order to facilitate a better understanding of the characteristics of the invention to those skilled in the art, a detailed description will be made on the basis of the accompanying drawings. Like numbers refer to like elements. The drawings are not necessarily drawn to scale.

DETAILED DESCRIPTION OF THE PREFERRED EMBODIMENT

Figure 1:
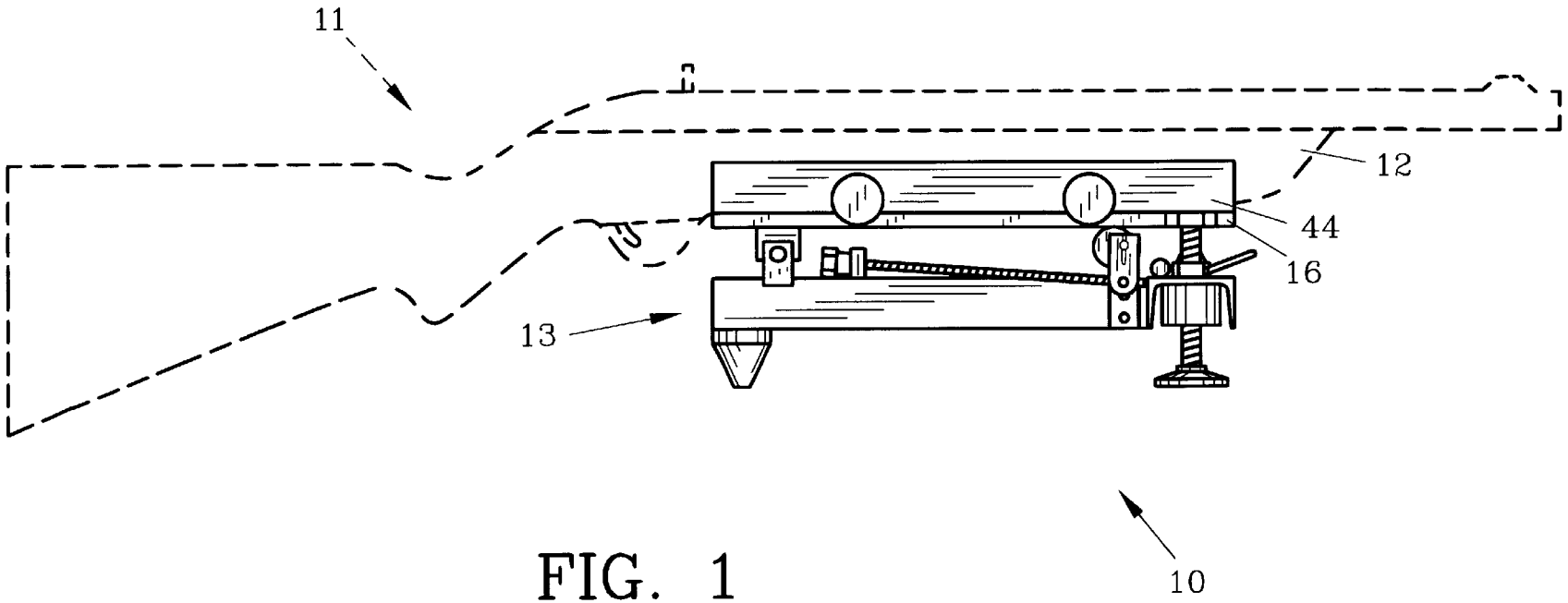
FIG. 1 shows a side elevational view of a firearm bench rest according to a preferred embodiment of the invention with a supported firearm shown in phantom.

FIG. 1 depicts the preferred embodiment of a firearm bench rest 10 according to the invention supporting a rifle 11. Bench rest 10 includes a platform 13 supporting a firearm forestock support plate 16. Clamping blocks such as 44 secure the forestock 12 of the firearm.

Figure 5:
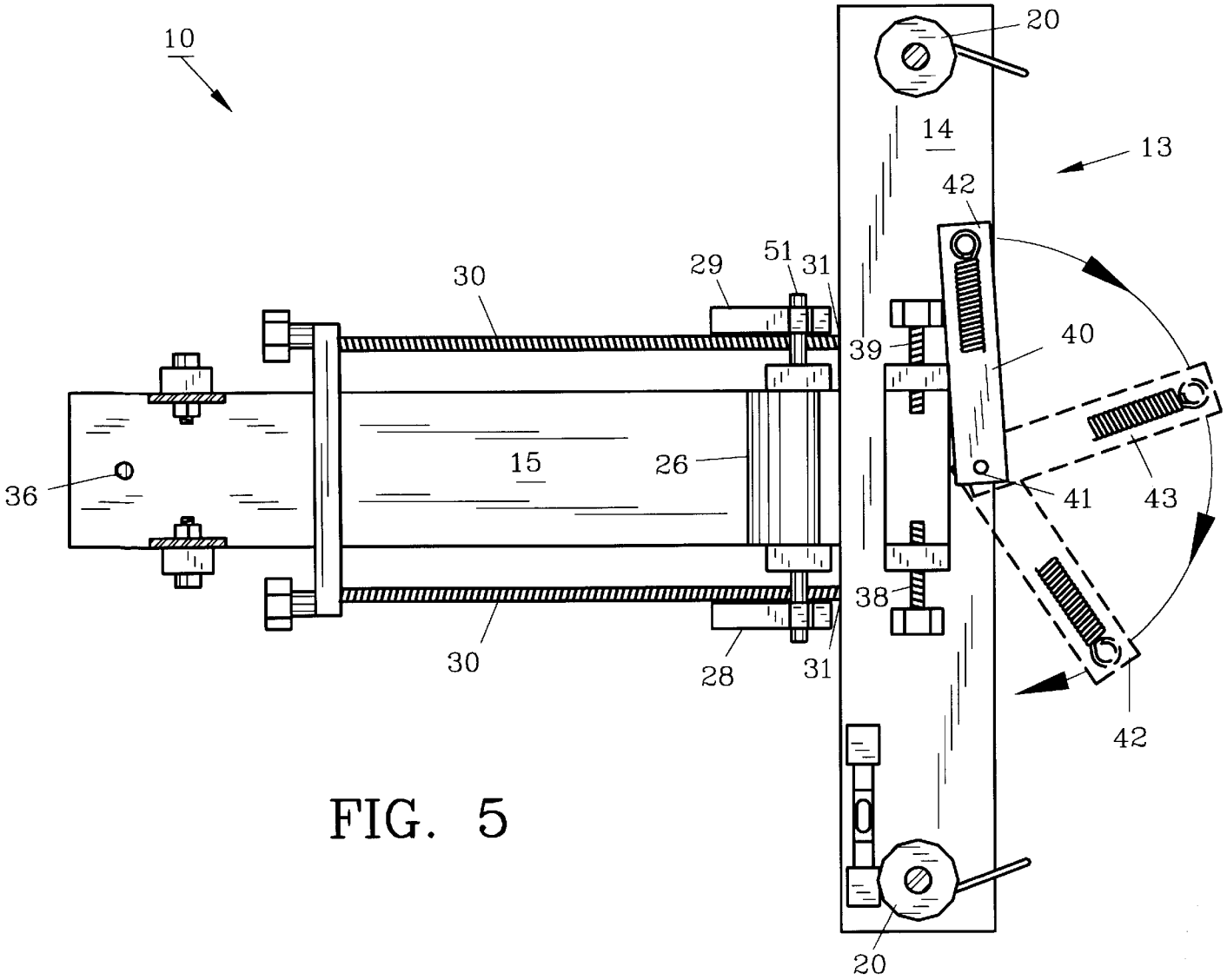

As best seen in FIG. 5, platform 13 includes a front bar 14 welded to a rear bar 15. Rear bar 15 is mounted to the middle of front bar 14 and is perpendicular to front bar 14, thereby presenting a T-shaped profile. Front bar 14 and rear bar 15 may be formed from aluminum channel stock which is three inches wide and 1½ in deep.

Figure 3:
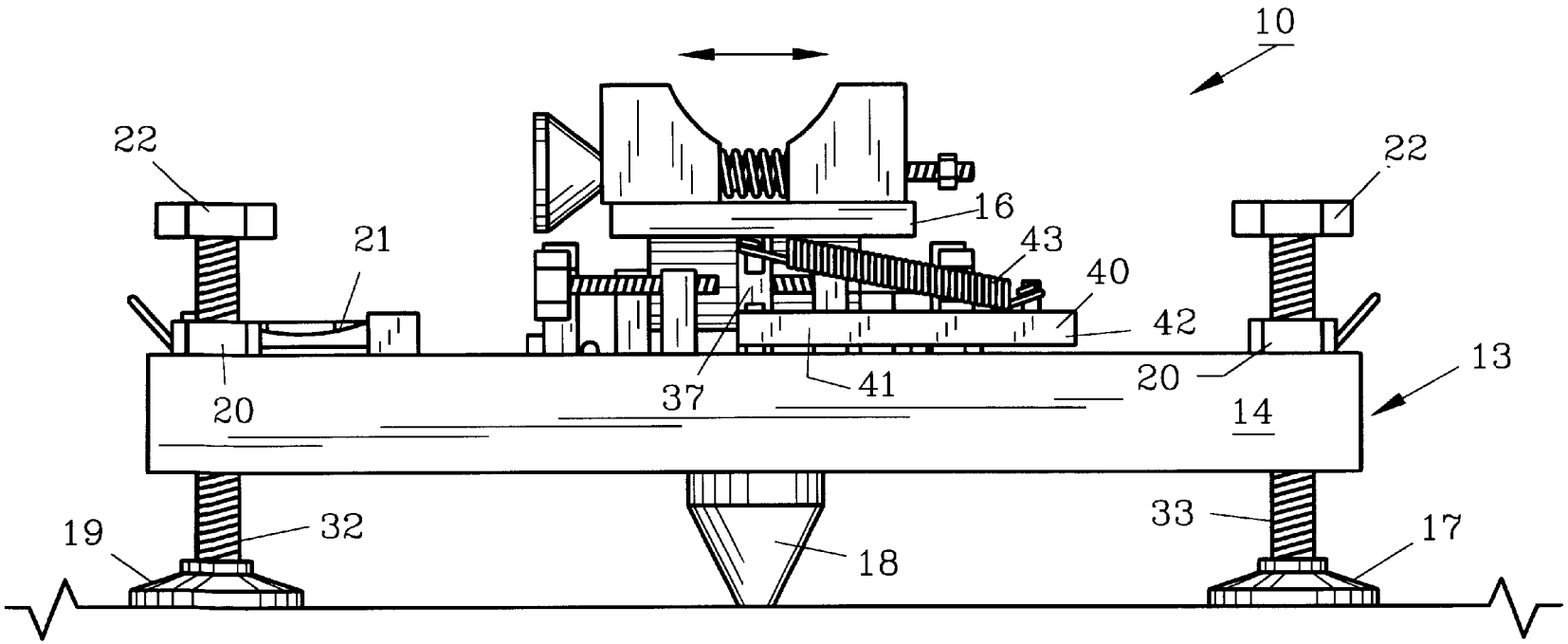
FIG. 3 shows a front elevational view of the embodiment of FIG. 1.

As best seen in FIG. 3, rear bar 15 is supported by rear support 18, which may be formed from nylon polymer material. Rear support 18 is secured to rear bar 15 by a fastener inserted into a drilled and tapped hole. Front bar 14 is supported by steel screws 32,33 which are vertically disposed and respectively are supported by bases 19, 17. Each vertical screw has a density of eleven threads per inch and is provided with a brass knob 22 and a brass locking nut 20, which has a handle inclined at ten degrees from horizontal. The initial orientation of bench rest 10 is established by the placement of support 18 and bases 17, 19. The approximate height of front bar 14 is established by rotation of knobs 22. Fluid level 21 is used to ensure that platform 13 is level. Locking nuts 20 then are tightened to prevent further change in the height of front bar 14.

Fine Elevation Adjustment

Figure 4:
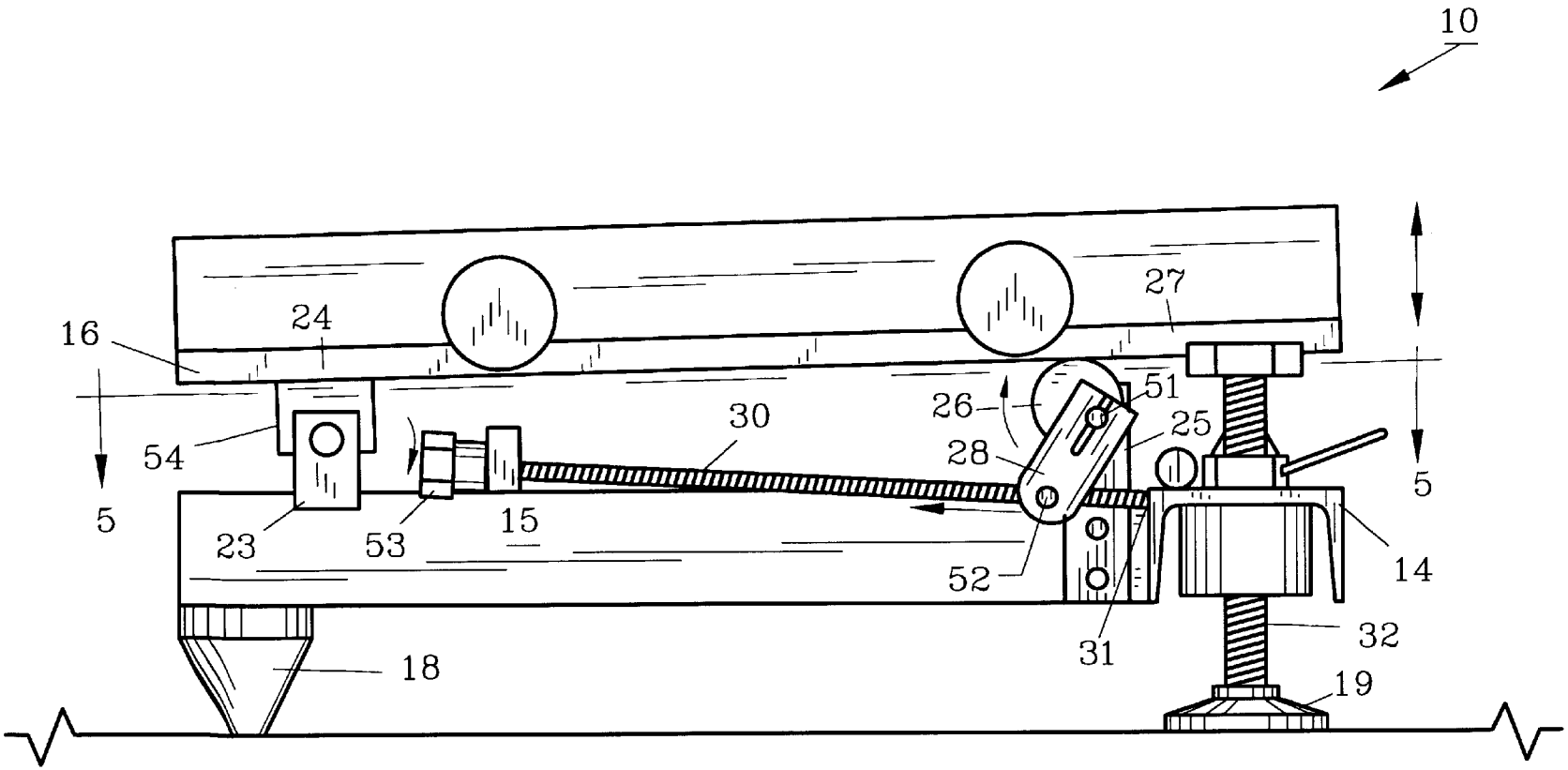
FIG. 4 shows an enlarged side elevational view of the embodiment of FIG. 1; and, FIG. 5 shows a top plan view of the embodiment of FIG. 1 taken along line 5—5 of FIG. 4.

As best seen in FIG. 4, rear bar 15 supports a hinge 23 at its rear portion and a bracket 25 at its front portion. Firearm forestock support plate 16 is mounted at its rear portion at a first plate location 24 to hinge 23 for rotation in a vertical plane. Turning to FIG. 5, a solid cylindrical rotatable support member 26, which may be formed from nylon polymer material, is eccentrically mounted on a horizontal pin 51 which is supported by bracket 25. Pin 51 is mounted at its respective ends to the proximal ends of first and second levers 28, 29. Levers 28, 29 respectively are connected at their distal ends to horizontal pins 52.

Elevation screws 30 are mounted to each side of rear bar 15 and each passes through a pin 52. Rotation of an elevation screw knob 53, as shown by the arrow in the left side of FIG. 4, advances a screw 30. The distal end of lever 28 is moved rearward (as shown by the left-oriented arrow in FIG. 4) as screw 30 is advanced. This causes rotation of pin 51, which rotates support member 26 in the direction shown by the arrow to the left of support member 26 in FIG. 4. The forestock support plate 16 rests at a second plate location 27 on support member 26. As support member 26 is eccentrically mounted on pin 51, the elevation of the second plate location 27 changes responsive to the advancing of a knob 53.

In the preferred embodiment, the thread density of vertical screws 32,33 may be eleven threads per inch (2.54 cm). The thread density of screws 30 is preferably higher than the thread density of the vertical screws, and may be 20 threads per inch (2.54 cm). Fine elevation adjustment is thereby made by turning either knob 53 found to be convenient by the marksman. Knobs 53 may be provided with washers formed of polymer material such as nylon.

The marksman therefore may quickly establish the correct vertical elevation of a firearm resting on a firearm forestock support plate by providing a platform having supports adapted to rest on a surface; hingedly supporting said support plate rear end to said platform; and adjusting the elevation of said support plate front end by rotating an eccentrically mounted support member.

Fine orientation adjustment

Rotatable support member 26 preferably formed from a smooth material such as nylon. Support plate 16 is free to slide at its second plate location 27 to either side over support member 26 within a limited range. Support plate 16 is rotatably supported at its location 35 about a pin 36 (see FIG. 2) which passes through channel member 54 (see FIG. 4). Channel member 54 is free to rotate in the vertical plane on hinge 23. Therefore, support plate may rotate in the horizontal about pin 36 to a limited extent.

As best seen in FIG. 3, a stop bar 37 depends from the front end of support plate 16. Windage screws 38,39 (see FIG. 5) are horizontally mounted to either side of stop bar 37 and each advances towards it. A spring support bar 40 is mounted at its proximal end 41 to the upper surface of front bar 14 for horizontal rotation. Spring support bar 40 also has a distal end 42 which supports one end of a tension spring 43. The other end of tension spring 43 is supported by the front end of support plate 16. Bar 40 may be flipped to either side as shown by the arrows in FIG. 5. As seen by the arrows in FIG. 3, support plate 16 thereby is urged by spring 43 to one side until stop bar 37 rests against one of the windage screws 38, 39. The windage screw selected then may be advanced or retracted by turning its knob, thereby accomplishing fine orientation adjustment of support plate 16.

Figure 2:
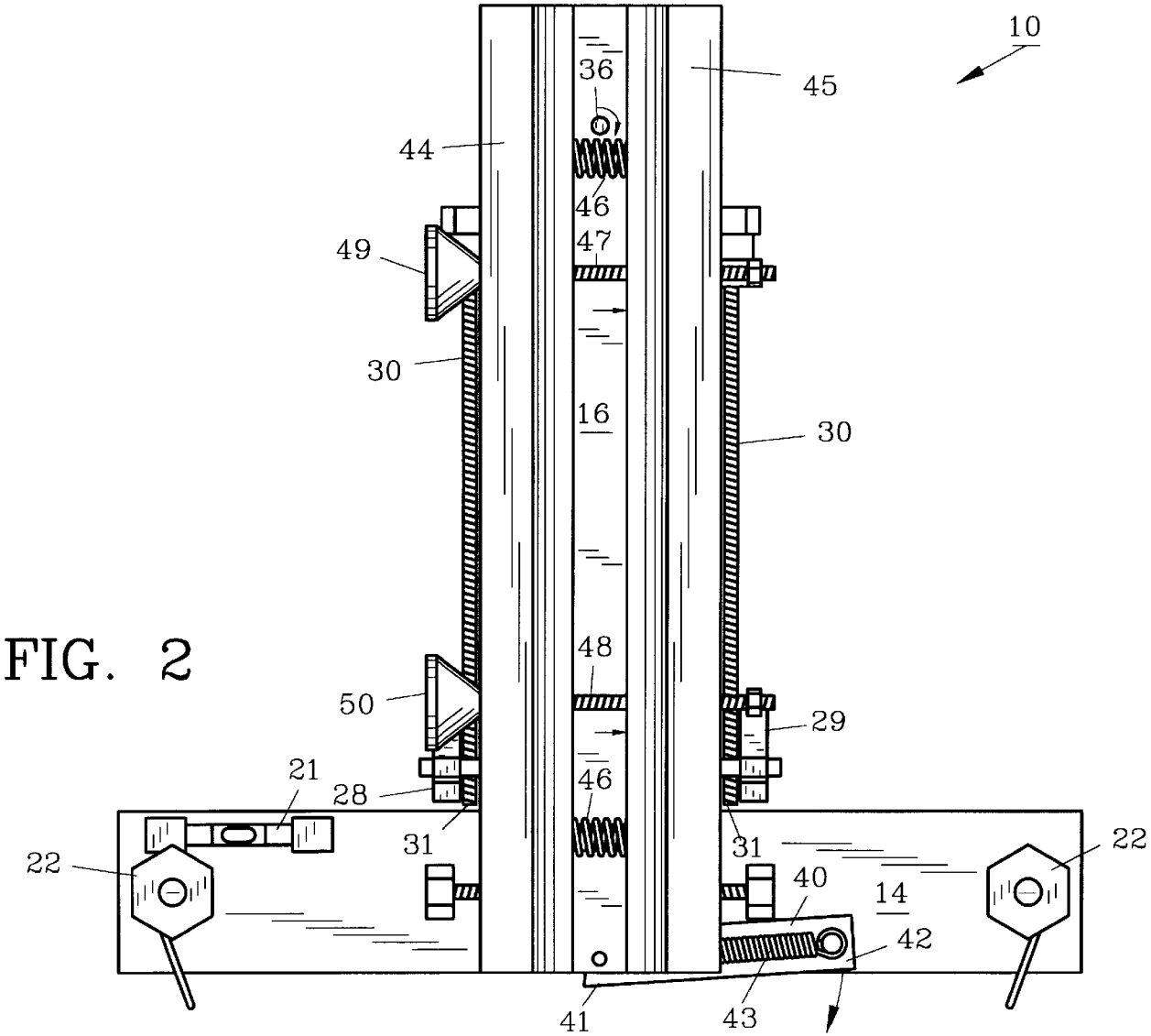
FIG. 2 shows a top plan view of the embodiment of FIG. 1.

Support plate 16 is provided with fixed clamping block 44 and slidable clamping block 45 as seen in FIG. 2. Compression springs 46 are mounted between blocks 44,45 on horizontal pins connecting blocks 44,45. Knobs 49, 50 may be turned to advance or retract block screws 47, 48 to clamp forestock 12.

The marksman therefore may quickly adjust the orientation of a firearm resting on a firearm forestock support plate by providing a stop bar depending from a front end of said support plate; mounting a rear end of said support plate for horizontal rotation with respect to a platform; and urging said stop bar to rest against either a first windage screw advancing from one side of said platform or a second windage screw advancing from the other side of said platform.

Since the invention may be embodied in several forms without departing from the spirit or essential characteristics thereof, the preceding description is intended to be illustrative and not restrictive, since the scope of the invention is defined by the claims rather than by the description preceding them.

What is claimed is:

1. A firearm bench rest, comprising:

a platform supported by at least one front support and a rear support;

a firearm forestock support plate hingedly mounted at a first plate location to said platform;

a bracket mounted to and extending upward from said platform;

a rotatable support member eccentrically mounted to said bracket and supporting said forestock support plate at a second plate location; and, a first lever movable to rotate said support member, thereby adjusting the elevation of said second plate location.

2. A firearm bench rest as set out in claim 1, further comprising a second lever movable to rotate said support member, said support member disposed between said first lever and said second lever so that said first lever is disposed to one side of said support plate and said second lever is disposed to the other side of said support plate, whereby the elevation of said second plate location may be adjusted by movement of either said first lever or said second lever.

3. A firearm bench rest as set out in claim 1, wherein said platform comprises a front bar and a rear bar perpendicularly joined to said front bar.

4. A firearm bench rest as set out in claim 3, further comprising an elevation screw, said elevation screw having a first thread density and threadedly engaging said first lever, said elevation screw thereby moving said first lever when said screw is advanced while being supported by said platform front bar.

5. A firearm bench rest as set out in claim 4, further comprising a vertical elevation screw supporting said front bar, said vertical screw having a thread density lower than said first thread density.

6. A firearm bench rest as set out in claim 1, further comprising first and second vertical screws supporting said platform and a fluid level supported by said platform.

7. A method of using the firearm bench rest of claim 1, said method comprising the step of rotating said eccentrically mounted support member to adjust the elevation of said second plate location.

8. A firearm bench rest, comprising:

a platform;

a firearm forestock support plate having a length and mounted to said platform for horizontal rotation at a first plate location;

a stop bar depending from said firearm forestock support plate;

first and second horizontally disposed windage screws each mounted to said platform so as to advance in a direction perpendicular to said length, such that said stop bar is between said first and second windage screws;

a spring support bar hingedly mounted at a proximal end thereof to said platform; and a tension spring mounted between a distal end of said spring support bar and said firearm forestock support plate, whereby said stop bar may be biased by said tension spring to rest against either said first windage screw or said second windage screw.

9. A method of using the firearm bench rest of claim 8, said method comprising the step of urging said stop bar to rest against either said first windage screw advancing from one side of said platform or said second windage screw advancing from the other side of said platform.

* * * * *